United States Patent [19]

Rullier

[11] Patent Number: 4,576,397

[45] Date of Patent: Mar. 18, 1986

[54] ADJUSTMENT DISPLAY FOR SKI BINDING

[75] Inventor: Pierre Rullier, Annecy, France

[73] Assignee: Salomon S.A., Annecy, France

[21] Appl. No.: 573,643

[22] Filed: Jan. 25, 1984

[30] Foreign Application Priority Data

Feb. 11, 1983 [FR] France ..... 83 02726

[51] Int. Cl.[4] ..... A63C 9/08

[52] U.S. Cl. ..... 280/625; 280/634; 340/571

[58] Field of Search ..... 280/611, 612, 625, 626, 280/634; 320/1; 340/568, 571

[56] References Cited

U.S. PATENT DOCUMENTS

| | | | |
|---|---|---|---|
| 3,728,675 | 4/1973 | Horn et al. | 340/539 X |
| 4,140,331 | 2/1979 | Salomon | 280/612 |
| 4,311,321 | 1/1982 | Svoboda | 280/611 |
| 4,327,360 | 4/1982 | Brown | 340/568 X |
| 4,403,790 | 9/1983 | Bauer et al. | 280/809 X |

FOREIGN PATENT DOCUMENTS

| | | |
|---|---|---|
| 0033131 | 1/1981 | European Pat. Off. . |
| 2309257 | 11/1976 | France . |
| 2430778 | 2/1980 | France . |

*Primary Examiner*—Joseph F. Peters, Jr.
*Assistant Examiner*—Michael Mar
*Attorney, Agent, or Firm*—Sandler & Greenblum

[57] ABSTRACT

A display apparatus for displaying the state of adjustment of a ski binding jaw composed of a plurality of maintenance elements for maintaining the boot in the horizontal plane. The display apparatus includes a sensor for sensing the proper and improper adjustment of the maintenance elements with respect to the boot in a horizontal plane, and an indicator element which produces a perceptible signal when the maintenance elements are properly adjusted in the horizontal plane with respect to the boot. In one embodiment, the jaw comprises three maintenance elements, each of which contains a sensor. In this embodiment, an electrical circuit connects the sensors to the indicator element. When the boot contacts each of the sensors simultaneously, the electrical circuit is closed and the indicator element produces a perceptible signal. In another embodiment, three indicator elements are provided, each of which is attached to one of the sensors. The sensors are connected in parallel to the electrical circuit so that one indicator element will be activated when sensors to which it is attached contacts the boot.

56 Claims, 6 Drawing Figures

ADJUSTMENT DISPLAY FOR SKI BINDING

BACKGROUND OF THE INVENTION

1. Field of the Invention

The present invention relates to an adjustment display for ski bindings which cooperate with one end of a boot and which are adapted to respond to forces exerted in a horizontal plane, i.e., parallel to the plane of the ski.

2. Description of the Prior Art

Bindings which comprise at least one lateral retention element for a boot are known. It is common for this lateral retention element to be adapted to move with respect to the ski so as to allow to the release of the boot when a lateral force of the boot exceeds a pre-set value or threshold, thereby preventing bodily harm to the skier. It is, therefore, very important that the adjustment of the release threshold of the binding be correct. In addition, it is also important that the positioning of the retention element with respect to the sole of the boot, which is a determining factor with respect to the reliability of the release threshold, be correct. It is also important that the skier be aware of whether the retention element is properly or improperly adjusted so as to be able to make the necessary corrections.

A typical ski boot binding jaw comprises a plurality of boot retention elements which assure the retention of the boot in a horizontal plane. At least two of these elements are normally adjustable with respect to each other to adapt the binding to the length, width, and configuration of the boot.

Normally, the adjustment of the position of the boot relative to the retention elements is made visually by perceiving the play which exists between retention elements and the sole of the boot. Alternatively, sheets, made of plastic for example, are interposed between the retention elements and the sole of the boot and are removed after the adjustment. These sheets, therefore, function as thickness gauges to measure the play between the boot and the retention elements. In this method, verification of the proper adjustment is also performed visually, which is a particularly unreliable manner of verification.

Another type of verification involves noting a "hard point" in the rotation of an adjustment screw when a retention element, for example, a lateral wing, makes contact with the boot. This "sensitive" method is likewise of little reliability. Furthermore, improper adjustments can always occur after this initial adjustment, particularly because of various phenomena, such as, the presence of snow wedged between the sole of the boot and the retention elements.

French Pat. No. 2,309,257 attempts to solve this verification problem by providing a vertical bias detector which senses the forces exerted by the binding on the sole of the boot during rest, for bindings in which these vertical forces would normally be absent. A mechanical indicator, normally flush with a surface, moves to the edge of a reference surface in the event the binding experiences abnormal forces. However, determining the position of this mechanical indicator again involves a purely visual and at best a subjective verification of the adjustment of the retention elements. An improvement is provided by substituting an electro-mechanical indicator for the mechanical indicator, wherein, in the case of an excessive vertical constraint, a mechanical element closes an electronic interruptor controlling the energization of a bulb.

The apparatus described in the French patent, however, has a number of inadequacies resulting from its construction. In addition, it can only detect an abnormal vertical force such as a pinching of the sole, and, cannot sense any horizontal force resulting from, for example, improper positioning of the sole of the boot with respect to the pertinent retention elements in the horizontal plane.

A much more complex type of detector is proposed in French Application No. 2,430,778. In this type of detector, one or more electrical contacts are activated by pressure from the sole of the boot when the sole is abnormally pinched in the vertical direction by the front jaw or the rear stop, because of, for example, snow under the sole. Again, in this case, it is not possible to note a defective positioning of the retention elements with respect to the sole of the boot in a horizontal plane.

SUMMARY OF THE INVENTION

It is the object of the present invention to furnish reliable information on the position of the retention elements by providing a display apparatus for displaying the state of adjustment of the ski binding, particularly with respect to the retention elements of the ski boot sole in a horizontal plane.

The present invention performs this function and the various functions described above which have been disregarded in the prior art devices, even though these functions are extremely important. The device, according to the present invention, includes an indicator for indicating the proper adjustment of the retention elements of the sole in the horizontal plane. Furthermore, this indicator is an objective indicator, i.e., it is an indicator that conveys information that does not depend upon detailed visual discrimination of the position of the indicator by the user.

In one embodiment, the apparatus is designed to display the state of adjustment of the ski binding having at least one maintenance element adapted to be adjusted with respect to a boot in a horizontal plane. The states of adjustment comprise proper adjustment and improper adjustment of the binding in a horizontal plane. In this embodiment, the apparatus comprises sensor means and indicator means. This sensor means senses the state of adjustment of at least one maintenance element with respect to the boot in a horizontal plane, and the indicator means emits a perceptible signal when the maintenance element is in one of the states of adjustment.

In an alternative embodiment, the device is designed to be used with a binding comprising a jaw adapted to retain one of the ends of the boot. In this embodiment, the jaw comprises a plurality of maintenance elements for maintaining the boot in a horizontal plane and for contacting the sole of the boot. At least one of the maintenance elements is adjustable with respect to at least one of the other maintenance elements. In this embodiment, each maintenance element comprises the sensor means.

The indicator means emits a perceptible signal when the maintenance elements are properly adjusted and the indicator means does not emit this perceptible signal when the maintenance elements are improperly adjusted.

In one embodiment, the sensor means comprises an electrical contact. In this embodiment the apparatus further comprises an electrical circuit, connecting the electrical contact and the indicator means. The indicator means emits a perceptible signal when the electrical circuit is closed and does not emit a perceptible signal when the electric circuit is open. The electrical circuit is closed when the electrical contacts are closed and the electrical circuit is open when the electrical contacts are open. The electrical contacts, in turn, are closed when the boot contacts the electrical contacts on the maintenance elements. In an alternative embodiment, the electrical contacts are closed when the boot contacts the electrical contacts with a pre-determined force. In addition, the electrical contacts are open when the boot is spaced from the electrical contacts.

In another embodiment, the binding may comprise a central maintenance element and two lateral maintenance elements. In this case, the apparatus of the present invention further comprises at least three electrical contacts, each of which is connected to one of the maintenance elements.

In one embodiment, the electrical contacts are connected in series with an electrical circuit so that the indicator means emits its perceptible signal only when all the contacts are simultaneously closed. It is evident, that the electrical circuit also comprises an energization means for energizing the circuit.

In an alternative embodiment, using three electrical contacts, the electrical contacts are connected to the electrical circuit in parallel. In this embodiment, the indicator means comprises three indicator means, each of which is connected to one of the electrical contacts, whereby each sensor means emits a perceptible signal only when the electrical contact to which it is connected is closed.

In another embodiment, the indicator means is activated to emit a perceptible signal when the electrical contacts are closed. In this embodiment, the electrical circuit further comprises a timing circuit, for interrupting the activation of the indicator means at the end of a predetermined time period. In addition, this pre-determined time period is adjustable.

In one embodiment, the indicator means is an electroluminescent diode which emits a visual signal. In an alternative embodiment, the indicator means emits an aural signal. In addition, in one embodiment, the timing circuit may comprise a capacitor in combination with a potentiometer.

In another embodiment, the invention comprises an apparatus for displaying at least one of a plurality of states of adjustment of a ski binding with respect to a boot in a horizontal plane. These states of adjustment comprise a proper adjustment and an improper adjustment of the binding with respect to the boot in a horizontal plane. In this embodiment, the apparatus comrises at least one indicator element which produces a perceptible signal in response to said binding being in one of said states of adjustment, and does not produce said perceptible signal when said binding is in a second of the states of adjustment. Furthermore, the apparatus also comprises a sensing means for sensing the states of adjustment of the binding. In this embodiment, the indicator element is activated to produce the perceptible signal in response to the sensing means sensing one of the states of adjustment.

The sensing means can be adapted to be connected to the binding. In this embodiment, the sensing means is disposed on a support zone of the binding. This support zone is adapted to contact the boot when the binding is properly adjusted. In this case the indicator element is activated to produce the perceptible signal in response to the boot contacting the support zone and the sensing means. Alternatively, the indicator element is activated to produce a perceptible signal in response to the boot contacting the sensing means with a predetermined force.

In one embodiment, this perceptible signal is a visual signal, which can be produced by an electroluminescent diode. Alternatively, the perceptible signal may be a sound or aural signal.

In another embodiment, the sensing means comprises an electrical contact, and the apparatus further comprises an electrical circuit connecting this electrical contact to the indicator element. The electrical circuit is closed when the boot contacts the electrical contact and the electrical circuit is open when the boot is spaced from the electrical contact. In this embodiment, the indicator element is activated in response to theflow of electricity through a closed electrical circuit, and the indicator element is not activated or deactivated when the electrical circuit is opened.

In still another embodiment, the apparatus further comprises at least three spaced apart electrical contacts connected to the electrical circuit in series. Because these contacts are connected in series, the indicator element is activated only when all of the electrical contacts are simultaneously closed when the boot contacts these three contacts. In one embodiment using this design, the binding to which the apparatus is attached may comprise a central maintenance element and two lateral maintenance elements. Each electrical contact is connected to a different maintenance element.

Alternatively, the three electrical contacts may be connected to the electrical circuit in parallel. In this embodiment, the apparatus comprises, in addition, at least three indicator elements, each connected to one of the electrical contacts. Each indicator element is activated when the boot contacts the electrical contact to which the indicator element is connected.

In addition, the electrical circuit may further comprises a timing circuit, interrupting the activation of the indicator element at the end of a predetermined, adjustable period of time.

Another embodiment of the invention comprises a method for displaying at least one of the states of adjustment of the ski binding with respect to a boot. These states of adjustment comprise a proper adjustment and an improper adjustment of the binding with respect to the boot in a horizontal plane. The method comprises: sensing one of the states of adjustment of the binding in a horizontal plane, with a sensing means; and producing a perceptible signal by activating an indicator means in response to sensing one of the states of the adjustment of the binding in a horizontal plane. The method may further comprise sensing another of the states of adjustment of the binding in a horizontal plane with the sensing means, and deactivating the indicator means, thereby preventing the indicator from producing a perceptible signal, in response to sensing of another of the states of adjustment of the binding in a horizontal plane.

The sensing means may comprise at least three spaced apart electrical contacts disposed on a support zone of the binding. This support zone is adapted to contact the boot when the binding is properly adjusted. In this case, the first sensing step comprises sensing contact of the boot with the three electrical contacts. In addition, the first producing step may comprise producing a visual signal.

In another embodiment, an electrical circuit connects the electrical contacts and the indicator element. In this embodiment, the electrical circuit is adapted to be open when the boot is spaced from the electrical contacts, and the electrical circuit is adapted to close when the boot contacts these electrical contacts. In this embodiment, the producing step further comprises closing this electrical circuit, and the deactivating step comprises opening the electrical circuit.

In addition, the producing step may comprise producing the perceptible signal only when the three electrical contacts contact the boot simultaneously.

In an alternative embodiment, the indicator means comprises three indicator elements, each of which is connected to one of the electrical contacts. In this embodiment, the electrical contacts are connected to the electrical circuit in parallel. In this embodiment, therefore, the producing step comprises producing a perceptible signal from one of the indicator elements, when one of the electrical contacts contacts the boot. In another embodiment of the invention, the method may further comprise interrupting the perceptible signal after a predetermined time.

BRIEF DESCRIPTION OF THE DRAWINGS

The invention will now be described with reference to several embodiments described below, and illustrated in the attached drawings, given by way of non-limiting example, in which.

DESCRIPTION OF THE PREFERRED EMBODIMENTS

Known ski bindings typically comprise a central support positioned along the longitudinal axis of the ski, and two lateral supports comprising wings, whose position is adjustable. These supports maintain the sole of the boot in the horizontal plane at the level of either a front stop and/or a heel stop. If the contact surface of the two lateral supports with the sole is inclined with respect to the axis of the ski, these lateral supports themselves can, as necessary, by virtue of the longitudinal component of their action, perform the function of the central support. Bindings of this type, having two or three support points for one end of the boot, at least two of which are adjustable, are abundant in the market and are very well known to those skilled in the art. Thus, it is not necessary to describe such apparatus in detail, particularly since the present invention is not specific to the structure of these apparatus nor the manner in which the adjustment occurs. Rather, the present invention relates to the quality of these adjustments, i.e., whether the supports are properly or improperly adjusted. Therefore, the present invention can be used with any type of binding.

Generally, the apparatus of the present invention comprises a sensor for sensing the state of adjustment of maintenance elements of the binding with respect to the boot in a horizontal plane, and indicator element or elements for producing a perceptible signal when the maintenance element is in one of the states of adjustment. In one embodiment the sensor comprises an electrical contact which is connected to a support zone of the maintenance elements of the binding. The support zone of each maintenance element is adapted to contact the boot when the boot is properly adjusted. The electrical contact is also connected to an information processing circuit which activates the indicator element, indicating the state of the contact. In other words, the contact, the circuit and the indicator translate the state of adjustment of the maintenance element into a signal which indicates to the user the state of adjustment of these maintenance elements. The electrical contacts can be of any appropriate known type, known to those skilled and, therefore, further description of these elements is unnecessary.

For example, the electrical contacts may comprise "Huton 225" contacts "Gaviers Membranes" made by Hutchinson Electric, or "Jeanrenaud" commutators made by I.T.T.

In the following discussion, by way of example, reference is made to a front safety binding having a jaw with a central maintenance element comprising a support for supporting the sole, and two lateral wings. It is understood that other alternative embodiments can be envisioned by a simple transposition of these elements without going beyond the skill of those of ordinary skill in the art.

Figure 1:
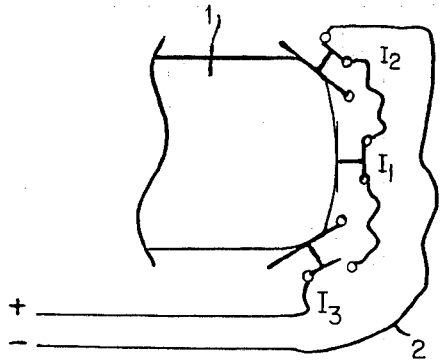
FIGS. 1–3 schematically illustrate one embodiment of the invention and the state of the binding, respectively, in the case where there is a proper adjustment of the binding with respect to the boot (FIG. 1), in the case where the wings of the binding are pinched excessively (FIG. 2), and in the case in which lateral wings are opened to too large an extent (FIG. 3)

FIG. 1 schematically illustrates one end of a boot 1, which, when it is inserted into a binding (not shown), normally comes into contact with and closes a central electrical contact $I_1$, and two lateral electrical contacts $I_2$ and $I_3$ which are connected to the support zones of the adjustable maintenance wings. In this case, the binding is considered properly adjusted. Contacts $I_1$, $I_2$, and $I_3$ in a known manner, are normally biased to an open position in the absence of a force exerted on them. When the sole of the boot contacts them or is supported on them, or on an element which is connected to them, they move to a closed position and close an electrical circuit 2 which activates and controls an indicator 3, seen in FIG. 4. Only when all three contacts are closed simultaneously is electrical circuit 2 closed and indicator 3 activated. To this end, in FIGS. 1–3, contacts $I_1$, $I_2$ and $I_3$ are connected to electrical circuit 2 in series. Electrical circuit 2 connects contacts $I_1$, $I_2$ and $I_3$ to indicator 3 and can be of the type shown in FIG. 4, whose operation will be explained below.

As was previously explained, a proper adjustment of the binding elements causes a closure of contacts $I_1$, $I_2$, and $I_3$ when the boot has been properly inserted into the binding as shown in FIG. 1. In this case, contacts $I_1$, $I_2$, and $I_3$ are closed, thereby closing an electrical circuit 2 and activating indicator element 3. Proper adjustment of the binding occurs when the boot contacts the support zones of each maintenance element simultaneously. Improper adjustment of the binding occurs when the boot does not contact the support zones of each maintenance element simultaneously. Of course, when the bindings comprise only one maintenance element, proper adjustment occurs when the boot contacts the support zone of this one maintenance element.

It should be noted that it is within the scope of the invention to arrange contacts $I_1$, $I_2$ and $I_3$ and circuit 2 such that indicator 3 is activated when the binding is improperly adjusted, and indicator 3 is deactivated when the binding is properly adjusted.

Figure 2:
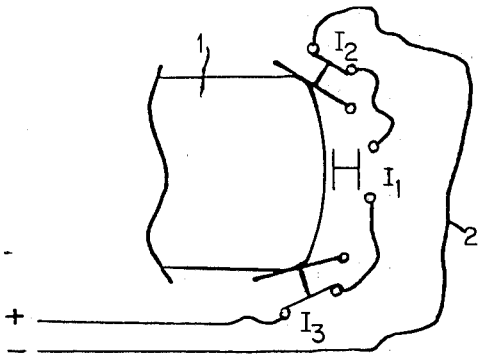

FIG. 2 illustrates the case of a poor adjustment, or improper adjustment, in which the lateral wings are pinched too close together. In this case, during the insertion of the boot into the binding, boot 1 closes lateral contacts $I_2$ and $I_3$, but does not rest against contact $I_1$ which thus remains open and therefore, indicator element 3 cannot be activated. It is thus appropriate, to adjust the pinching of the wings. This is accomplished by loosening the wings until indicator element 3 is activated, i.e., closure of central contact $I_1$ under the pressure of the boot.

Figure 3:
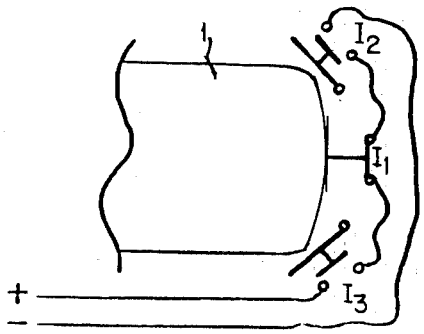

FIG. 3 illustrates the reverse situation, i.e., the wings are opened to too great an extent. In this case, the sole is freely supported against central contact $I_1$ without touching lateral contacts $I_2$ and $I_3$. It is appropriate,. therefore, to retighten the wings until indicator element 3 is activated, i.e., simultaneous closure of contacts $I_1$, $I_2$ and $I_3$ occurs.

Between these two extreme situations of improper adjustment, an intermediate situation (not shown) should be discussed in which central contact $I_1$ and a single lateral contact $I_2$ or $I_3$ close during the insertion of the boot in the binding. In this case one might adjust, at least, the wing which, in its normal position, does not contact the boot.

In all of these cases discussed above, indicator 3 which indicates proper adjustment of the binding, is not activated until all three contacts are simultaneously closed, which thus dictates their being positioned in series in circuit 2.

Figure 4:
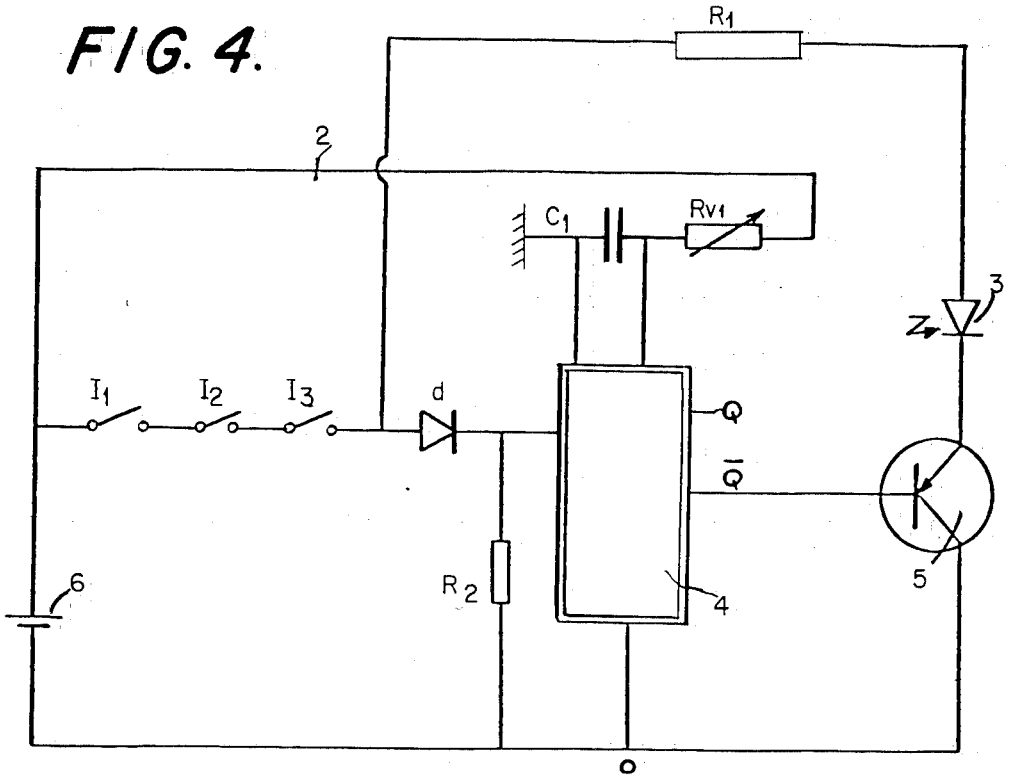
FIG. 4 illustrates one embodiment of an electrical circuit connecting the electrical contacts to one indicator element.

FIG. 4 illustrates one embodiment of electrical circuit 2. When the binding is properly adjusted, contacts $I_1$, $I_2$ and $I_3$ close, the input of the monostable flip-flop 4 becomes "1" and the output Q goes to "0" level. Transistor PNP 5 has its base negatively biased and thus becomes a conductor which allows current source 6 to activate the electroluminescent diode 3 which serves as indicator element 3. In the case of an improper adjustment of the binding, at least one of the contacts $I_1$, $I_2$, or $I_3$ is open and diode 3 remains dark, or turned off, until, by means of adjustment of the maintenance elements, one achieves simultaneous closure of the three contacts $I_1$, $I_2$ and $I_3$.

The other components of circuit 2 are a diode d for controlling a monostable flip-flop 4, a resistor R1 for loading the electroluminescent diode 3 and a resistor R2 for the grounding, that is at the "0" level, of the input of monostable flip-flop 4, when at least one of the contacts $I_1$, $I_2$ and $I_3$ is open. This permits, in all situations, one to know of the input state of monostable flip-flop 4 and to prevent flip-flop 4 from functioning in an unpredictable fashion.

Furthermore, in order to save energy, and thus increase the longevity of energization or power source 6, diode 3, automatically turns off after being activated by the closure of $I_1$, $I_2$ and $I_3$. The period of time before which diode 3 is turned off is adjustable and can be adjusted to be long enough for the operator or the user of the binding to note that diode 3 is activated. This automatic deactivation of diode 3 is controlled by timing circuit C1RV1. The timing circuit comprises a capacitor ($C_1$) and a potentiometer (RV1) which acts on monostable flip-flop 4.

Figure 5:
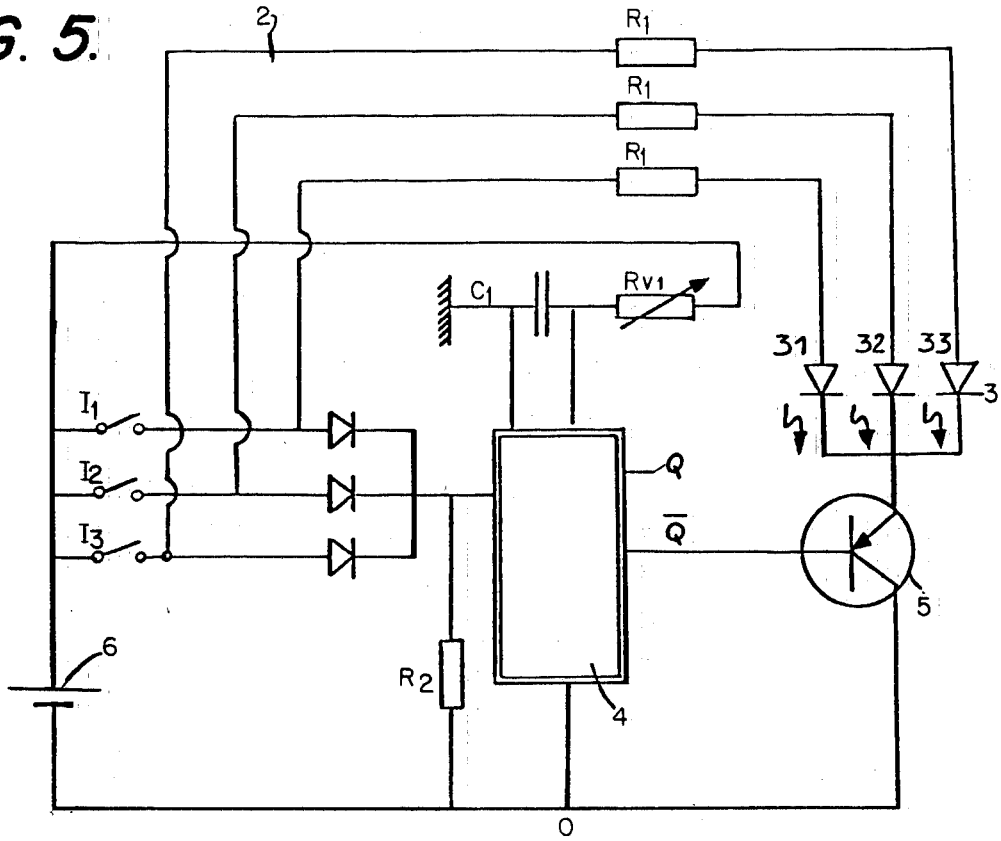
FIG. 5 illustrates an electrical circuit analogous to the circuit shown in FIG. 4, connected to three indicator elements.

The embodiment which has just been described with reference to FIG. 4 is particularly economical with respect to energy consumption. However, because indicator element 3 comprises a single electroluminescent diode, it does not permit one to become aware of which of contacts $I_1$, $I_2$ and $I_3$ remain open when diode 3 turns off. Therefore, one does not know which maintenance element or elements require further adjustment. Such a discrimination between contacts $I_1$, $I_2$ and $I_3$ is possible with the embodiment of circuit 2 shown in FIG. 5. This circuit is substantially the same as the preceding circuit in FIG. 4 with the difference that the indicator 3 has been replaced by individual electroluminescent indicator diodes 31, 32, and 33 which are each connected to one of contacts $I_1$, $I_2$ and $I_3$ by a load resistor R1 and a control diode D1, D2 and D3 of monostable flip-flop 4. In this embodiment, $I_1$, $I_2$ and $I_3$ are no longer mounted in series but in parallel. Each contact is connected to one diode. When the three diodes 31, 32 and 33 are simultaneously illuminated, the binding is properly adjusted. If all three diodes are not simultaneously illuminated, one is immediately able to determine which adjustments need to be performed, i.e., one can determine which contacts $I_1$, $I_2$ or $I_3$ must be closed to properly adjust the binding, and therefore, one can proceed with all of the adjustments until all of the diodes 31, 32, and 33 are illuminated.

In the preceding discussion, reference has been made to contacts $I_1$, $I_2$ and $I_3$, which are open or closed due to the force of the boot sole pushing against the contacts. The precise construction of these contacts is not part of the present invention and it is clear that any type of appropriate contacts may be used for implementing the present invention. In particular, contacts may be used which do not close until a certain pressure threshold has been exceeded, which pressure threshold is either preset and/or adjustable, particularly with respect to the central support.

Figure 6:
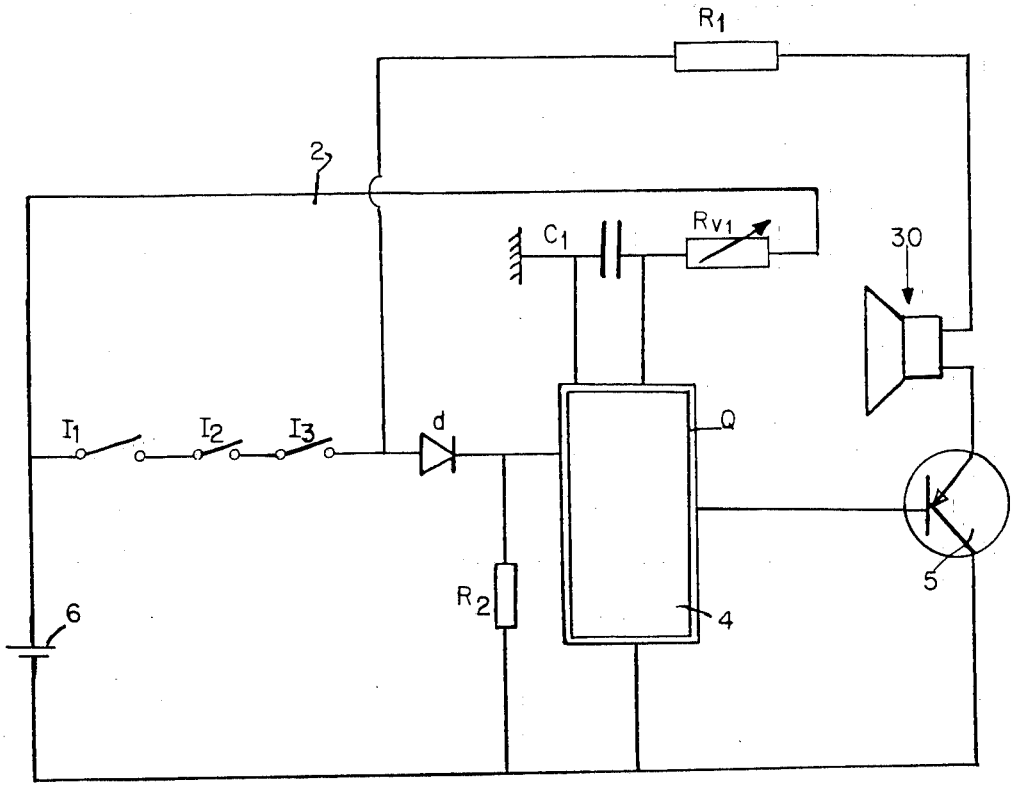
FIG. 6 illustrates another embodiment of the electrical circuit, which is identical to FIG. 4, with the exception that diode 3 in FIG. 4 is replaced by a sound indicator 30.

Furthermore, in the embodiment described by way of example, one or more indicators 3 are electroluminescent diodes. It is obvious that any other visual or sound indication elements may be used whose output is directly perceptible to the user. For example, FIG. 6 shows a circuit, identical to FIG. 4, but using a sound indicator 30, rather than electroluminescent diodes to indicate the proper adjustment of the binding.

Finally, although the invention has been described with reference to particular means, materials and embodiments, it is to be understood that the invention is not limited to the particulars disclosed and extends to all equivalents covered by the claims.

What is claimed is:

1. An apparatus for displaying the state of adjustment of a ski binding having at least one maintenance element adapted to be displaced with respect to a boot in a horizontal plane into first and second states of adjustment, wherein in said first state of adjustment said at least one maintenance element is properly adjusted with respect to said boot in a horizontal plane, wherein in said second state of adjustment said at least one maintenance element is improperly adjusted with respect to said boot in a horizontal plane, wherein said apparatus comprises:

(a) sensor means for sensing the first and second states of adjustment of said at least one maintenance element with respect to said boot in a horizontal plane; and (b) indicator means for emitting a percepticle signal to indicate the horizontal state of adjustment of said at least one maintenance element with respect to said boot in response to said sensor sensing at least one of said states of adjustment of said at least one maintenance element.

2. The apparatus as defined in claim 1 wherein said binding comprises a jaw adapted to retain one of the ends of said boot and wherein said jaw comprises a plurality of maintenance elements for maintaining said boot in a horizontal plane and adapted to contact the solen of said boot, and wherein said at least one of said maintenance elements is adjustable with respect to at least one of said other maintenance elements, and wherein each maintenance element comprises sensor means.

3. The apparatus as defined by claim 2 wherein said indicator means emits said perceptible signal when said maintenance elements are properly adjusted and said indicator means does not emit said perceptible signal when said maintenance elements are improperly adjusted.

4. The apparatus as defined by claim 2 wherein said sensor means comprises an electrical contact and said apparatus further comprises an electrical circuit, connecting said electrical contact with said indicator means.

5. The apparatus as defined by claim 3 wherein said indicator means emits said perceptible signal when said electrical circuit is closed, and wherein said electrical circuit is closed when said electrical contacts are closed.

6. The apparatus as defined in claim 5 wherein said electrical contacts are closed when said boot contacts said electrical contacts.

7. The apparatus as defined by claim 5 wherein said electrical contacts are closed when said boot contacts said electrical contacts with a predetermined force.

8. The apparatus as defined by claim 6 wherein said indicator means does not emit said perceptible signal when said electrical circuit is open, and wherein said electrical current is open when said electrical contacts are open.

9. The apparatus as defined by claim 8 wherein said electrical contacts are open when said boot is spaced from said electrical contacts.

10. The apparatus as defined by claim 9 wherein said binding comprises a central and two lateral maintenance elements and wherein said apparatus further comprises at least three electrical contacts, each of which is connected to one of said maintenance elements.

11. The apparatus as defined by claim 10 wherein said electrical contacts are connected in series with said electrical circuit, wherein said indicator means emits said perceptible signal only when all of said electrical contacts are simultaneously closed.

12. The apparatus as defined by claim 11 wherein said electrical circuit further comprises energization means for energizing said circuit.

13. The apparatus as defined by claim 10 wherein said contacts are connected to said electrical circuit in parallel and wherein said indicator means comprises three indicator means, each of which is connected to one of said electrical contacts, whereby each indicator means emits said perceptible signal only when said electrical contact to which it is connected is closed.

14. The apparatus as defined in claim 9 wherein said indicator means is activated to emit said perceptible signal when said electrical contacts are closed and wherein said electrical circuit further comprises a timing circuit interrupting the activation of said indicator means at the end of a predetermined time period, wherein said predetermined time period is adjustable.

15. The apparatus as defined by claim 9 wherein said indicator means emits a visual signal.

16. The apparatus as defined by claim 15 wherein said indicator means comprises an electroluminescent diode.

17. The apparatus as defined by claim 9 wherein said indicator means emits an aural signal.

18. The apparatus as defined by claim 14 wherein said timing circuit comprises a capacitor in combination with a potentiometer.

19. An apparatus for displaying at least one of a plurality of states of adjustment of a ski binding with respect to a boot in a horizontal plane, wherein said binding is adapted to be displaced in a horizontal plane into first and second states of adjustment, wherein in said first state of adjustment said binding is properly adjusted with respect to said boot in a horizontal plane, wherein in said second state of adjustment said binding is improperly adjusted with respect to said boot in a horizontal plane, wherein said apparatus comprises:

at least one indicator element which produces a perceptible signal in response to said binding being in one of said states of adjustment with respect to said boot in a horizontal plane, wherein said at least one indicator element does not produce said perceptible signal in response to said binding being in the other of said states of adjustment with respect to said boot in a horizontal plane.

20. The apparatus as defined by claim 19 wherein said apparatus further comprises sensing means for sensing said states of adjustment of said binding, and wherein said indicator element is activated to produce said perceptible signal in response to said sensing means sensing one of said states of adjustment.

21. The apparatus as defined by claim 20 wherein said sensor means is adapted to be connected to said binding.

22. The apparatus as defined by claim 21 wherein said binding comprises a support zone, and wherein said sensing means is disposed on said support zone of said binding, wherein said support zone is adapted to contact said boot when said binding is properly adjusted and wherein said indicator element is activated to produce said perceptible signal in response to said boot contacting said support zone and said sensing means.

23. The apparatus as defined by claim 21 wherein said indicator element is activated to produce said perceptible signal when said boot contacts said sensing means with a predetermined force.

24. The apparatus as defined by claim 19 wherein said perceptible signal is a visual signal.

25. The apparatus as defined by claim 24 wherein said indicator element is an electroluminescent diode.

26. The apparatus as defined by claim 22 wherein said sensing means comprises an electrical contact and said apparatus further comprises an electrical circuit connecting said electrical contact with said indicator element, wherein said electrical circuit is closed when said boot contacts said electrical contact and said electrical circuit is open when said boot is spaced from said electrical contact, and wherein said indicator element is activated in response to the flow of electricity through said closed electric circuit, and said indicator element is not activated when said electrical circuit is open.

27. The apparatus as defined by claim 26 wherein said apparatus further comprises at least three spaced apart electrical contacts, connected to said electrical circuit in series, whereby said indicator element is activated only when all of said electrical contacts simultaneously contact said boot.

28. The apparatus as defined by claim 27 wherein said binding comprises a central maintenance element and two lateral maintenance elements, wherein each electrical contact is connected to a different maintenance element.

29. The apparatus as defined by claim 26 wherein said apparatus further comprises at least three electrical contacts connected to said electrical circuit in parallel and wherein said apparatus further comprises at least three indicator elements, each connected to one of said electrical contacts, wherein each indicator element is activated when said boot contacts said electrical contacts to which said indicator element is connected.

30. The apparatus as defined by claim 26 wherein said electrical circuit further comprises a timing circuit for interrupting activation of said indicator element at the end of a predetermined period of time.

31. A method for displaying at least one of the states of adjustment of a ski binding with respect to said boot in a horizontal plane, wherein one of said states of adjustment comprises the proper adjustment of said binding with respect to said boot in a horizontal plane and another of said states of adjustment comprises the improper adjustment of said binding with respect to said boot in a horizontal plane wherein said binding is adapted to be displaced between said first and second states of adjustment wherein said method comprises the steps of:

(a) sensing one of said states of adjustment of said binding in a horizontal plane with respect to said boot with a sensing means; and (b) producing a perceptible signal by activating indicator means in response to sensing one of said states of adjustment of said binding in a horizontal plane with respect to said boot.

32. The method as defined by claim 31, wherein said method further comprises:

(c) sensing another of said states of adjustment of said binding in a horizontal plane with a sensing means; and (d) deactivating said indicator means thereby preventing said indicator means from producing said perceptible signal, in response to sensing said another of the states of adjustment of said binding in a horizontal plane.

33. The method as defined by claim 32 wherein said sensing means comprises at least three spaced apart electrical contacts disposed on support zones of said binding, wherein said support zone is adapted to contact said boot when said binding is properly adjusted and wherein sensing step (a) comprises sensing contact of said boot with said three electrical contacts.

34. The method as defined by claim 33 wherein said producing step (b) comprises producing a visual signal.

35. The method as defined by claim 33 wherein an electrical circuit connects said electrical contacts and said indicator element, and wherein said electrical circuit is adapted to open when said boot is spaced from said electrical contacts, and said electrical circuit is adapted to close when said boot contacts said electrical contacts, and wherein producing step (b) further comprises closing said electrical circuit, and deactivating step (d) comprises opening said electrical circuit.

36. The method as defined by claim 35 wherein said producing step (b) further comprises producing said perceptible signal only when said three electrical contacts contact said boot simultaneously.

37. The method as defined by claim 35 wherein said indicator means comprises three indicator elements, each of which is connected ot one of said electrical contacts and wherein said electrical contacts are connected to said electrical circuit in parallel, wherein said producing step (b) comprises producing a perceptible signal from one of said indicator elements when one of said electrical contacts contacts said boot.

38. The method as defined by claim 31 further comprising:

(e) interrupting said perceptible signal after a predetermined time.

39. A ski binding comprising:

(a) at least one maintenance element for holding one end of a ski boot onto a ski, wherein said at least one maintenance element is displaceable in a horizontal plane with respect to said boot into first and second states of adjustment, wherein in said first state of adjustment said at least one maintenance element is properly adjusted with respect to said boot in a horizontal plane, wherein in said second state of adjustment said at least one maintenance element is improperly adjusted with respect to said boot in a horizontal plane;

(b) sensor means for sensing the state of adjustment of said at least one maintenance element in a horizontal plane with respect to said boot; and (c) indicator means for emitting a perceptible signal to indicate said horizontal state of adjustment of said at least one maintenance element in a horizontal plane with respect to said boot in response said sensor means sensing one of said states of adjustment of said at least one maintenance element.

40. The binding as defined by claim 39 further comprising at least two maintenance elements, at least one of which is adjustable with respect to the other in a horizontal plane.

41. The binding as defined by claim 40 wherein said indicator means emits said perceptible signal when said maintenance elements and said boot are properly adjusted with respect to each other in a horizontal plane and said indicator means does not emit said perceptible signal when said maintenance elements and said boot are improperly adjusted with respect to each other in a horizontal plane.

42. The binding as defined by claim 40 wherein said sensor means comprises an electrical contact and said binding further comprises an electrical circuit, connecting said electrical contact with said indicator means.

43. The binding as defined by claim 42 wherein said indicator means emits said perceptible signa when said electrical circuit is closed, and wherein said electrical circuit is closed when said electrical contacts are closed.

44. The binding as defined by claim 43 wherein said electrical contacts are closed when said boot contacts said electrical contacts.

45. The binding as defined by claim 43 wherein said electrical contacts are closed when said boot contacts said electrical contacts with a predetermined force.

46. The binding as defined by claim 45 wherein said indicator means does not emit said perceptible signal when said electrical circuit is open, and wherein said electrical circuit is open when said electrical contacts are open.

47. The binding as defined by claim 46 wherein said electrical contacts are open when said boot is spaced from said electrical contacts.

48. The binding as defined by claim 47 wherein said binding further comprises a central and two lateral maintenance elements and wherein said binding further comprises at least three electrical contacts, each of which is connected to one of said maintenance elements.

49. The binding as defined by claim 48 wherein said electrical contacts are connected in series with said electrical circuit, wherein said indicator means emits said perceptible signal only when all of said electrical contacts are simultaneously closed.

50. The binding as defined by claim 48 wherein said contacts are connected to said electrical circuit in parallel and wherein said indicator means comprises three indicator means, each of which is connected to one of said electrical contacts, whereby each indicator means emits said perceptible signal only when said electrical contact to which it is connected is closed.

51. The apparatus as defined by claim 1 wherein said sensor means comprises means for sensing the improper and proper horizontal adjustment of said at least one maintenance element with respect to said boot in a horizontal plane, and wherein said indicator means comprises means for emitting a perceptible signal for indicating the proper or the improper horizontal adjustment of said at least one maintenance element with respect to said boot.

52. The method defined by claim 32 in combination with a method for adjusting a binding wherein said method for adjusting said binding comprises adjusting the horizontal position of said binding in response to production of said perceptible signal by the indicator means.

53. The apparatus defined by claim 1 in combination with said at least one maintenance element, wherein said at least one maintenance element is horizontally adjustable.

54. The apparatus defined by claim 19 in combination with said at least one maintenance element, wherein said at least one maintenance element is horizontally adjustable.

55. The apparatus defined by claim 53 in combination with two maintenance elements horizontally adjustable with respect to each other.

56. The apparatus defined by claim 54 in combination with two maintenance elements horizontally adjustable with respect to each other.

* * * * *